US005679240A

United States Patent [19]

Anastasijevic et al.

[11] Patent Number: 5,679,240

[45] Date of Patent: Oct. 21, 1997

[54] ANODE FOR THE ELECTROLYTIC WINNING OF METALS AND PROCESS

[75] Inventors: Nikola Anastasijevic, Altenstadt; Gerhard Jedlicka, Kelkheim; Karl Lohrberg, Heusenstamm, all of Germany

[73] Assignee: Metallgesellschaft Aktiengesellschaft, Frankfurt am Main, Germany

[21] Appl. No.: 679,683

[22] Filed: Jul. 11, 1996

[30] Foreign Application Priority Data

Jul. 12, 1995 [DE] Germany ..... 19525360

[51] Int. Cl.[6] ..... C25C 1/00; C25C 1/12; C25C 7/02; C25C 7/06

[52] U.S. Cl. ..... 205/560; 205/572; 205/576; 205/603; 204/275; 204/286; 204/290 F; 204/269

[58] Field of Search ..... 204/275, 279, 204/286, 290 F, 269; 205/560, 576, 603, 272, 134

[56] References Cited

U.S. PATENT DOCUMENTS

| | | | |
|---|---|---|---|
| 4,134,806 | 1/1979 | De Nora et al. | 205/560 |
| 4,391,695 | 7/1983 | Koziol et al. | 204/286 |
| 4,642,173 | 2/1987 | Koziol et al. | 204/288 X |
| 4,661,232 | 4/1987 | Koziol et al. | 204/286 |

FOREIGN PATENT DOCUMENTS

| | | |
|---|---|---|
| 0 089 475 | 9/1983 | European Pat. Off. . |
| 2 560 223 | 8/1985 | France . |
| 2 001 102 | 1/1979 | United Kingdom . |

OTHER PUBLICATIONS

"Dithiocarbamic Acid To Ethanol"; Ullmann's Encyclopedia of Industrial; Fith Completely Revised Edition, vol.A9; Wolfgang Gerhartz et al, 23 pages Dec. 1987.

*Primary Examiner*—Donald R. Valentine
*Attorney, Agent, or Firm*—Herbert Dubno; Jonathan Myers

[57] ABSTRACT

The anode comprises a substantially horizontal carrying bar, which is disposed outside the electrolyte and serves to supply electric current. Two substantially parallel metal surfaces (anode grids) are electrically conductively connected to the carrying bar and with at least one-half of their surface extending into the electrolyte. The carrying bar comprises a copper conductor, to which at least one vertical copper rod is joined. There is a direct electrically conducting connection between the copper conductor and the copper rod. The copper rod is surrounded by a titanium sheath and is an interference fit in that sheath. The copper rod provided with the titanium sheath is disposed between the two anode grids and is electrically conductively connected to said grids.

11 Claims, 1 Drawing Sheet

Fig.1
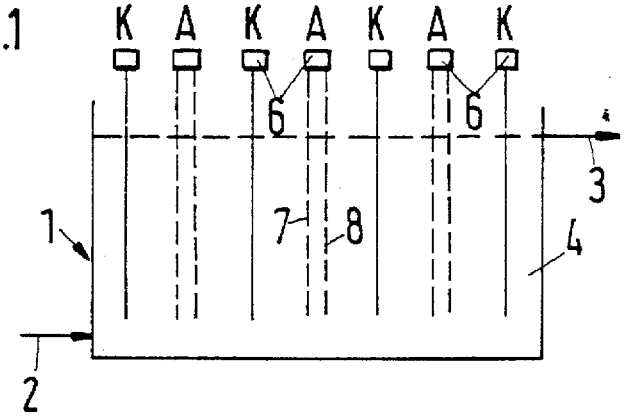
Fig.2
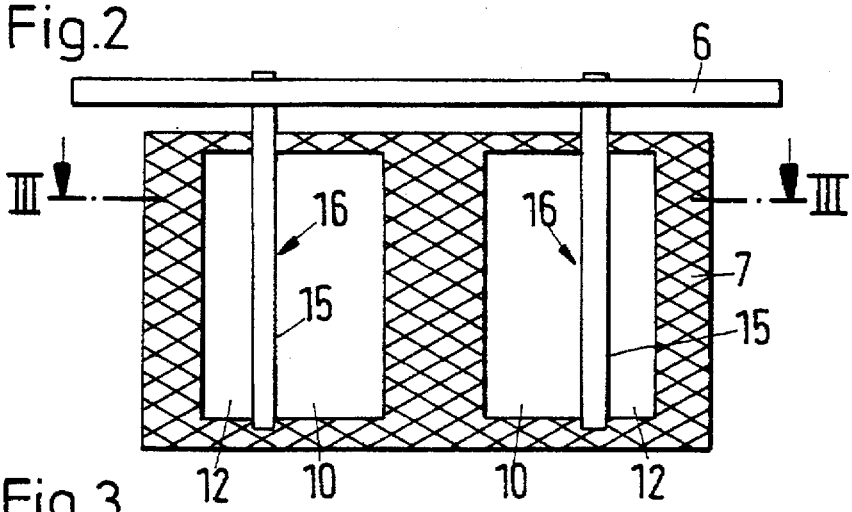
Fig.3
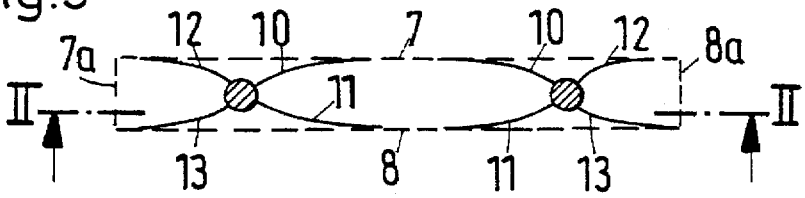
Fig.4
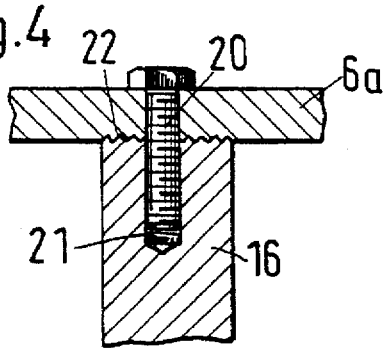
Fig.5
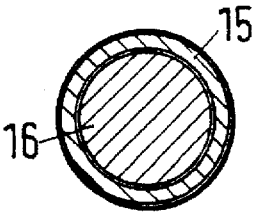
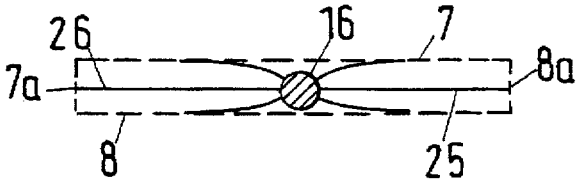
Fig.6

ANODE FOR THE ELECTROLYTIC WINNING OF METALS AND PROCESS

FIELD OF THE INVENTION

The present invention relates to a novel anode for the electrolytic extraction of a metal from an electrolyte in which the metal is ionogenically contained. The invention further relates to a process for electrolytic extraction of a metal from an electrolytic bath employing the anode. The invention further relates to an electrolytic cell including the anode for extraction of a metal from an electrolytic bath.

BACKGROUND OF THE INVENTION

An anode for the electrowinning of copper is known from DE-C-37 31 510 and is operated at current densities in the range of 600 to 1200 A/m$^2$. Perforated or grid-like anodes are also known from U.S. Pat. Nos. 3,915,834 and 4,113,586. Apertures are provided in the anode surface in order to reduce disturbances caused by evolution of gas and to ensure a more uniform distribution of the electric current in the electrolyte.

OBJECT OF THE INVENTION

It is the object of the invention to provide an anode which can be operated at high and very high current densities so that the anode can be used for an electrolysis resulting in high metal deposition rates.

SUMMARY OF THE INVENTION

The anode according to the present invention includes:

(a) a substantially horizontal carrying bar comprising a copper conductor, capable of conducting an electric current;

(b) at least one vertical copper rod surrounded by a titanium sheath in an interference fit in said sheath, said vertical copper rod physically joined to and directly electrically conductively connected to the copper conductor comprising said horizontal carrying bar; and (c) two anode grids lying generally in parallel planes and spaced apart from one another and between which the copper rod surrounded by a titanium sheath is disposed, said copper rod surrounded by said titanium sheath being electrically conductively connected to said two anode grids.

Current is supplied to the anode from the outside via the copper conductor and from the latter via one or more copper rods and through the associated titanium sheaths to the anode grids. As a result the anode grids can be supplied with high currents amounting to a plurality of 1000 amperes. Furthermore, a mechanically stable anode structure is provided so that the surfaces of the two anode grids with which the two anode grids are intended to be immersed into the electrolyte may have a height of at least one meter. The associated cathodes may have a corresponding large surface area so that the deposition rate will be improved.

According to a preferred feature the copper conductor of the carrying bar is screw-connected to the vertical copper rod. In another preferred feature the two anode grids are electrically conductively connected to the titanium sheath surrounding the copper rod by at least one spring element made of titanium. In yet another preferred feature the titanium sheath surrounding the copper conductor is sheet titanium.

The anode may further comprise at least one vertical sheet metal element located in the space between and generally parallel to the anode grids, where the vertical sheet metal element divides the space and is joined to inside surfaces of each of the two anode grids and joined to the titanium sheath surrounding the copper rod.

Also contemplated within the scope of the present invention is a process for electrolytic extraction of a metal from an electrolytic bath in which the metal is ionogenically contained, which comprises the steps of:

(A) providing an electrolytic cell which comprises:

an electrolytic cell container for holding an electrolytic bath in which is contained the metal in ionogenic form, said electrolytic cell container having an inlet means for adding the electrolytic bath and an outlet means for removing spent electrolytic bath;

anodes disposed in said electrolytic cell container and at least partially immersed in said electrolytic bath, each of said anodes comprising:

(a) a substantially horizontal carrying bar comprising a copper conductor, capable of conducting an electric current;

(b) at least one vertical copper rod surrounded by a titanium sheath in an interference fit in said sheath, said vertical copper rod physically joined to and directly electrically conductively connected to the copper conductor comprising said horizontal carrying bar; and (c) two anode grids lying generally in parallel planes and spaced apart from one another and between which the copper rod surrounded by said titanium sheath is disposed, said copper rod surrounded by said titanium sheath being electrically conductively connected to said two anode grids, wherein said anode grids extend into the electrolytic bath in said electrolytic cell container for at least one-half of their surface area;

sheet cathodes provided with a horizontal carrying bar, said cathodes at least partially immersed in said electrolytic bath and disposed alternatively with said anodes with a spacing of 10 to 100 mm in said electrolyte container; and a D.C. power source electrically connected to at least one of said anodes and to at least one of said cathodes;

(B) adding the electrolytic bath to the electrolytic cell container;

(c) applying a D.C. voltage between said anodes and said cathodes to electrolytically deposit the metal on the surface of said cathodes; and (D) removing the spent electrolytic bath from the electrolytic cell container.

Yet another feature of the process is an electrolytic cell for electrolytic extraction of a metal from an electrolytic bath in which the metal is ionogenically contained, which comprises:

an electrolytic cell container for holding an electrolytic bath in which is contained the metal in ionogenic form, said electrolytic cell container having an inlet means for adding the electrolytic bath and an outlet means for removing spent electrolytic bath;

at least one anode disposed in said electrolytic cell container and which is at least partially immersed in said electrolytic bath, which comprises:

a substantially horizontal carrying bar comprising a copper conductor, capable of conducting an electric current;

at least one vertical copper rod surrounded by a titanium sheath in an interference fit in said sheath, said vertical copper rod physically joined to and directly electrically conductively connected to the copper conductor comprising said horizontal carrying bar; and two anode grids lying generally in parallel planes and spaced apart from one another and between which the copper rod surrounded by a titanium sheath is disposed, said copper rod surrounded by said titanium sheath being electrically conductively connected to said two anode grids, wherein said anode grids extend into the electrolytic bath in said electrolytic cell container for at least one-half of their surface area;

sheet cathodes provided with a horizontal carrying bar, said cathode being at least partially immersed in said electrolytic bath and disposed alternatively with said anodes with a spacing of 10 to 100 mm in said electrolyte container; and a D.C. power source electrically connected to at least one of said anodes and to at least one of said cathodes.

During the operation of the electrolytic cell the copper rods of the anodes are contained in the electrolyte, which may consist, e.g., of copper sulfate. The titanium sheaths surrounding the rods afford a protection against a corrosive attack of the electrolyte. In order to achieve the necessary good conduction of current between the copper rod and the titanium sheath surrounding that rod, the copper rod is caused to be an interference fit in the titanium sheath as the latter is made. For that purpose it is recommended to work at elevated temperatures in the range from 400° to 700° C. The simultaneous manufacture of the copper rods and of the associated titanium sheaths may be accomplished in a manner known per se, e.g., by composite extrusion or other processes.

BRIEF DESCRIPTION OF THE DRAWINGS

Further features of the anode will be explained with reference to the drawing, in which:

FIG. 1 is a schematic longitudinal sectional view showing an electrolytic cell for winning metal, FIG. 2 is a longitudinal sectional view taken on line II—II in FIG. 3 and showing an anode, FIG. 3 is a transverse sectional view taken on line III—III in FIG. 2 and showing the anode, FIG. 4 is a longitudinal sectional view illustrating the joint between the carrying bar and a copper rod, FIG. 5 is a transverse sectional view showing a copper rod and a titanium sheath, and FIG. 6 is a schematic transverse sectional view showing a second embodiment of the anode.

DETAILED DESCRIPTION OF THE DRAWING

The electrolytic cell container 1 shown in FIG. 1 is provided with an inlet 2 for the electrolyte and with an outlet 3. Cathodes K and anodes A are alternatively disposed in the container 1 and are partly immersed into the electrolyte bath 4. Each cathode and each anode is provided with a horizontal carrying bar 6—see also FIG. 2—which is used to conduct current from an external d.c. source (not shown) to the electrode. The carrying bar 6 for the anode in accordance with the invention contains in its interior a copper conductor 6*a*, which is shown in FIG. 4. For protection against corrosion, the carrying bar 6 is surrounded by a sheath, which is made of sheet titanium and is not specifically shown.

As is apparent from FIGS. 1–3, each anode A comprises two parallel metal grids, which are described here as anode grids 7 and 8 and may consist of expanded metal grids. Alternatively, the grid structures may consist of sheet metal elements formed with closely spaced perforations. The anode grids 7 and 8 are made of titanium, which is activated in a manner known per se by a coating of mixed oxides based on Ru and/or Ir. Titanium sheets 10, 11, 12 and 13 are joined by spot welding to the inside surface of the anode grids 7 and are welded to the titanium sheaths 15 (see FIGS. 3 and 5), which surrounds the copper rods 16.

The two anode grids 7 and 8 are usually spaced 20 to 80 mm apart. Each anode grid has an angled edge portion 7*a* or 8*a*, at which the two anode grids are interconnected to increase the stability of the assembly. As is apparent from FIG. 3 the titanium sheets 10 to 13 are somewhat cambered to act like elastic springs, by which the anode grids 7 and 8 are forced apart under a slight pressure.

Owing to the grid structure of each anode any gas bubbles which are formed can rise substantially without a restriction out of the electrolyte bath 4. This will be of high significance particularly at high current densities because the increased evolution of gas would interfere with the motion of the ions in the electrolyte and may locally decrease the ion concentration.

FIG. 4 shows on an enlarged scale how the copper conductor 6*a* of the carrying bar 6 is screw-connected to a copper rod 16. The threads of the screw 20 are screwed into a tapped blind hole 21 in the top end portion of the copper rod 16. The surfaces 22 of the copper conductor 6*a* and at the end of the copper rod 16 are serrated or have been roughened otherwise in order to ensure a low-resistance joint. For the sake of clarity the titanium sheath 15 surrounding the copper rod 16 has not been shown in FIG. 4. The diameter of the copper rods 16—see also FIG. 5—is usually in the range from 10 to 40 mm. It is not essential for the copper rods to have a circular cross-sectional surface but they may also be rectangular or oval, for instance. The wall thickness of the titanium sheath 15 is usually in the range from 0.2 to 1 mm.

In the modified anode structure shown in FIG. 6, two vertical partition walls 25 and 26, which are parallel to the anode grids 7 and 8, extend between said grids and may also be made, e.g., of sheet titanium. The walls 25 and 26 are welded to the titanium sheath of the copper rod 16 and are electrically conductively connected also to the angled edge portions 7*a* and 8*a* of the anode grids 7 and 8 so that the partition walls 25 and 26 impart mechanical stability, conduct electric current from the copper rod 16 to the edge portions 7*a* and 8*a* of the anode grid, and serve also to guide the rising gas bubbles. Alternatively, partition walls 25 and 26 may be provided which are made of plastic, such as polyester or polypropylene, and in that case a thickness from 2 to 5 mm is preferred. Such plastic walls will also stabilize the anode structure and will improve the escape of gas bubbles.

What is claimed is:

1. An anode for electrolytic extraction of a metal from an electrolyte in which the metal is ionogenically contained, which comprises:

(a) a substantially horizontal carrying bar comprising a copper conductor, for conducting an electric current;

(b) at least one vertical copper rod surrounded by a titanium sheath in an interference fit in said sheath, said vertical copper rod being physically joined to and directly electrically conductively connected to said copper conductor;

(c) two mutually opposite anode grids lying generally in parallel planes and spaced apart from one another and between which the copper rod surrounded by said titanium sheath is disposed with spacing from the anode grids;

(d) a respective vertical titanium sheet metal elastic spring element located in the space between said anode grids and joined to said titanium sheath and bent outwardly from said titanium sheath into contact with a respective one of said anode grids, said vertical sheet metal elastic spring elements electrically conductively connecting said anode grids with said titanium sheath; and (e) at least one vertical partition wall extending between said two anode grids.

2. The anode for electrolytic extraction of a metal from an electrolyte defined in claim 1 wherein the two anode grids each have a height of at least 1 meter.

3. The anode for electrolytic extraction of a metal from an electrolyte defined in claim 1 wherein the copper conductor of the carrying bar is screw-connected to the vertical copper rod.

4. The anode for electrolytic extraction of a metal from an electrolyte defined in claim 1 wherein the copper conductor of the carrying bar is surrounded by a sheath of sheet titanium.

5. The anode for electrolytic extraction of a metal from an electrolyte defined in claim 1 wherein at least two of said vertical copper rods surrounded by titanium sheaths are provided in said space in mutually parallel relationship, and at least two of said vertical titanium sheet metal elastic spring elements located in the space between said anode grids and joined to said titanium sheath are bent outwardly from each of said titanium sheaths to extend into contact with respective ones of said anode grids.

6. The anode for electrolytic extraction of a metal from an electrolyte defined in claim 5 wherein each of said rods and the respective titanium sheaths is provided with a pair of outwardly bent further vertical titanium sheet metal elastic spring elements extending toward an edge of the anode grid.

7. A process for electrolytic extraction of a metal from an electrolytic bath in which the metal is ionogenically contained, which comprises the steps of:

(A) providing an electrolytic cell which comprises:

an electrolytic cell container for holding an electrolytic bath in which is contained the metal in ionogenic form, said electrolytic cell container having an inlet means for adding the electrolytic bath and an outlet means for removing spent electrolytic bath;

anodes disposed in said electrolytic cell container and at least adapted for partial immersion in said electrolytic bath, each of said anodes comprising:

(a) a substantially horizontal carrying bar comprising a copper conductor, for conducting an electric current;

(b) at least one vertical copper rod surrounded by a titanium sheath in an interference fit in said sheath, said vertical copper rod being physically joined to and directly electrically conductively connected to said copper conductor;

(c) two mutually opposite anode grids lying generally in parallel planes and spaced apart from one another and between which the copper rod surrounded by said titanium sheath is disposed with spacing from the anode grids, wherein said anode grids extend into said electrolytic cell container for at least one-half of their surface area;

(d) a respective vertical titanium sheet metal elastic spring element located in the space between said anode grids and joined to said titanium sheath and bent outwardly from said titanium sheath into contact with a respective one of said anode grids, said vertical sheet metal elastic spring elements dividing said space and electrically conductively connecting said anode grids with said titanium sheath; and (e) at least one vertical partition wall extending between said two anode grids;

sheet cathodes provided with a horizontal carrying bar, said cathodes at least adapted for partial immersion in said electrolytic bath and disposed alternatively with said anodes with a spacing of 10 to 100 mm in said electrolyte container; and a D.C. power source electrically connected to at least one of said anodes and to at least one of said cathodes;

(B) adding the electrolytic bath to the electrolytic cell container;

(C) applying a D.C. voltage between said anodes and said cathodes to electrolytically deposit the metal on the surface of said cathodes; and (D) removing the spent electrolytic bath from the electrolytic cell container.

8. The process defined in claim 7 wherein the metal is a transition metal.

9. The process defined in claim 7 wherein the transition metal is copper or zinc.

10. The process defined in claim 7 wherein according to step (C) the electrolytic deposition of the metal is carried out at a temperature of 400° to 700° C.

11. An electrolytic cell for electrolytic extraction of a metal from an electrolytic bath in which the metal is ionogenically contained, which comprises:

an electrolytic cell container for holding an electrolytic bath in which is contained the metal in ionogenic form, said electrolytic cell container having an inlet means for adding the electrolytic bath and an outlet means for removing spent electrolytic bath;

at least one anode disposed in said electrolytic cell container and which is adapted for partial immersion in said electrolytic bath, which comprises:

a substantially horizontal carrying bar comprising a copper conductor, for conducting an electric current;

at least one vertical copper rod surrounded by a titanium sheath in an interference fit in said sheath, said vertical copper rod being physically joined to and directly electrically conductively connected to said copper conductor comprising said horizontal carrying bar;

two mutually opposing anode grids lying generally in parallel planes and spaced apart from one another and between which the copper rod surrounded by said titanium sheath is disposed with spacing from the anode grids, wherein said anode grids extend into said electrolytic cell container for at least one-half of their surface area;

a respective vertical titanium sheet metal elastic spring element located in the space between said anode grids and joined to said titanium sheath and bent outwardly from said titanium sheath into contact with a respective one of said anode grids, said vertical sheet metal elastic spring elements electrically conductively connecting said anode grids with said titanium sheath; and at least one vertical partition wall extending between said two anode grids;

sheet cathodes provided with a horizontal carrying bar, said cathode being at least adapted for partial immersion in said electrolytic bath and disposed alternatively with said anodes with a spacing of 10 to 100 mm in said electrolyte container; and a D.C. power source electrically connected to at least one of said anodes and to at least one of said cathodes.

* * * * *